US007980442B2

(12) United States Patent
Kameda

(10) Patent No.: US 7,980,442 B2
(45) Date of Patent: Jul. 19, 2011

(54) CLINCH POSITIONING MECHANISM OF STAPLER

(75) Inventor: Futoshi Kameda, Tokyo (JP)

(73) Assignee: Max Co., Ltd., Tokyo (JP)

( * ) Notice: Subject to any disclaimer, the term of this patent is extended or adjusted under 35 U.S.C. 154(b) by 59 days.

(21) Appl. No.: 12/471,730

(22) Filed: May 26, 2009

(65) Prior Publication Data

US 2009/0294510 A1 Dec. 3, 2009

(30) Foreign Application Priority Data

May 28, 2008 (JP) ..... 2008-140115

(51) Int. Cl.
*B25C 5/02* (2006.01)

(52) U.S. Cl. ..... 227/155; 227/110

(58) Field of Classification Search ..... 227/155, 227/108, 110

See application file for complete search history.

(56) References Cited

U.S. PATENT DOCUMENTS

| | | | | |
|---|---|---|---|---|
| 5,799,935 | A | 9/1998 | Yamanushi et al. | |
| 7,621,434 | B2 * | 11/2009 | Sugihara | 227/155 |
| 7,681,770 | B2 * | 3/2010 | Kanai | 227/131 |
| 7,743,956 | B2 * | 6/2010 | Yagi et al. | 227/131 |
| 2006/0091180 | A1 * | 5/2006 | Kurabayashi | 227/131 |
| 2006/0186168 | A1 * | 8/2006 | Kameda | 227/107 |
| 2007/0246504 | A1 * | 10/2007 | Kanai | 227/155 |
| 2008/0029569 | A1 * | 2/2008 | Sugihara | 227/155 |
| 2009/0266864 | A1 * | 10/2009 | Kameda et al. | 227/120 |
| 2009/0266865 | A1 * | 10/2009 | Kameda | 227/120 |
| 2009/0294510 | A1 * | 12/2009 | Kameda | 227/155 |

FOREIGN PATENT DOCUMENTS

| | | |
|---|---|---|
| EP | 0 612 594 A1 | 8/1994 |
| EP | 1 518 650 A1 | 3/2005 |
| EP | 1 535 709 A1 | 6/2005 |
| EP | 1 795 306 A1 | 6/2007 |
| JP | 6-63343 | 9/1994 |

* cited by examiner

*Primary Examiner* — Brian Nash

(74) *Attorney, Agent, or Firm* — Drinker Biddle & Reath LLP

(57) ABSTRACT

A clinch positioning mechanism of a stapler is provided. The clinch positioning mechanism includes a driver unit and a clincher unit. The driver unit includes a driver for driving out a staple, and a guide piece. The clincher unit includes a clincher for bending and clinching a leg portion of the staple, and a guide hole for engaging with the guide piece. The clincher unit is arranged being opposed to the driver. At least one of the driver unit and the clincher unit is movably arranged, and the driver and the clincher are aligned with each other by engaging the guide piece in the guide hole at the latest when clinching the leg portion of the staple by the clincher.

4 Claims, 11 Drawing Sheets

CLINCH POSITIONING MECHANISM OF STAPLER

FIELD OF THE INVENTION

The present disclosure relates to a clinch positioning mechanism of a stapler in which a staple is driven out by a driver and a leg portion of the staple is bent and clinched by a clincher opposed to the driver.

DESCRIPTION OF RELATED ART

In a related-art stapler, for example, a driver unit (including a driver) is reciprocated by a reversible electric motor. In the related-art electrically operated stapler, in order to surely clinch a leg portion of a staple, it is necessary to execute a so-called alignment so that a clincher (a clincher groove formed in a clincher), which is arranged in a clincher unit, and a driver can be aligned with each other. That is, the alignment must be accomplished when the driver unit and the clincher unit are accurately positioned with respect to a body of the related-art stapler.

In order to align the clincher and the driver with each other, the following methods are adopted. One method is to add an alignment process into an assembling process of the related-art stapler. The other method is to enhance the accuracy of parts related to alignment positions of the driver unit and the clincher unit. As a related-art clinch positioning mechanism in a split type stapler, a Japanese Unexamined Utility Model Application Publication No. JP-UM-A-6-63343 discloses a driving device and a clincher device which are arranged being split from each other, and which are positioned by pins in a portion of a device such as a copier.

In both the alignment methods described above, a manufacturing cost of the stapler is raised. That is, in the method in which the alignment process is added, parts are assembled while the parts are aligned with each other and the inspection is made for the alignment. Therefore, it takes time and labor for the assembly and inspection and the manufacturing cost is raised. On the other hand, in the method in which the accuracy of each part is enhanced, a unit cost of each part is raised. As a result, the manufacturing cost of the stapler is increased.

In JP-UM-A-6-63343, the driving device and the clincher device are respectively positioned by pins in a portion of a device such as a copier. As a result, the manufacturing cost of the related-art stapler is increased.

SUMMARY OF INVENTION

Illustrative aspects of the present invention provide an inexpensive clinch positioning mechanism of a stapler in which a driver and a clincher can be easily positioned.

According to an illustrative aspect of the present invention, a clinch positioning mechanism is provided with: a driver unit which includes a driver for driving out a staple; a clincher unit which includes a clincher for bending and clinching a leg portion of the staple, and which is arranged being opposed to the driver. At least one of the driver unit and the clincher unit is movably arranged, and the driver unit includes a first guide portion for guiding the driver and the clincher unit includes a second guide portion for guiding the clincher so that the driver and the clincher can be aligned with each other at the latest when clinching the leg portion of the staple by the clincher.

In this case, the terminology of "at the latest when the leg portion of the staple is clinched by the clincher" is a concept containing a period of time from an initial state of the driver unit and the clincher unit to the start of clinching operation in the middle of moving of the driver unit or the clincher unit.

DETAILED DESCRIPTION OF EXEMPLARY EMBODIMENTS

Referring to FIGS. 1 to 5, a clinch positioning mechanism of a stapler of a first exemplary embodiment of the present invention will be explained below. In the first exemplary embodiment, explanations will be made into a case in which the stapler is of the electrically operated type and staples, which are rolled into a roller-shape, are accommodated in a staple cartridge. The electrically operated type stapler is incorporated, for example, into a copier or a facsimile terminal device and used for automatically stapling a predetermined number of sheets of paper processed by the copier or the facsimile terminal device.

Figure 1:
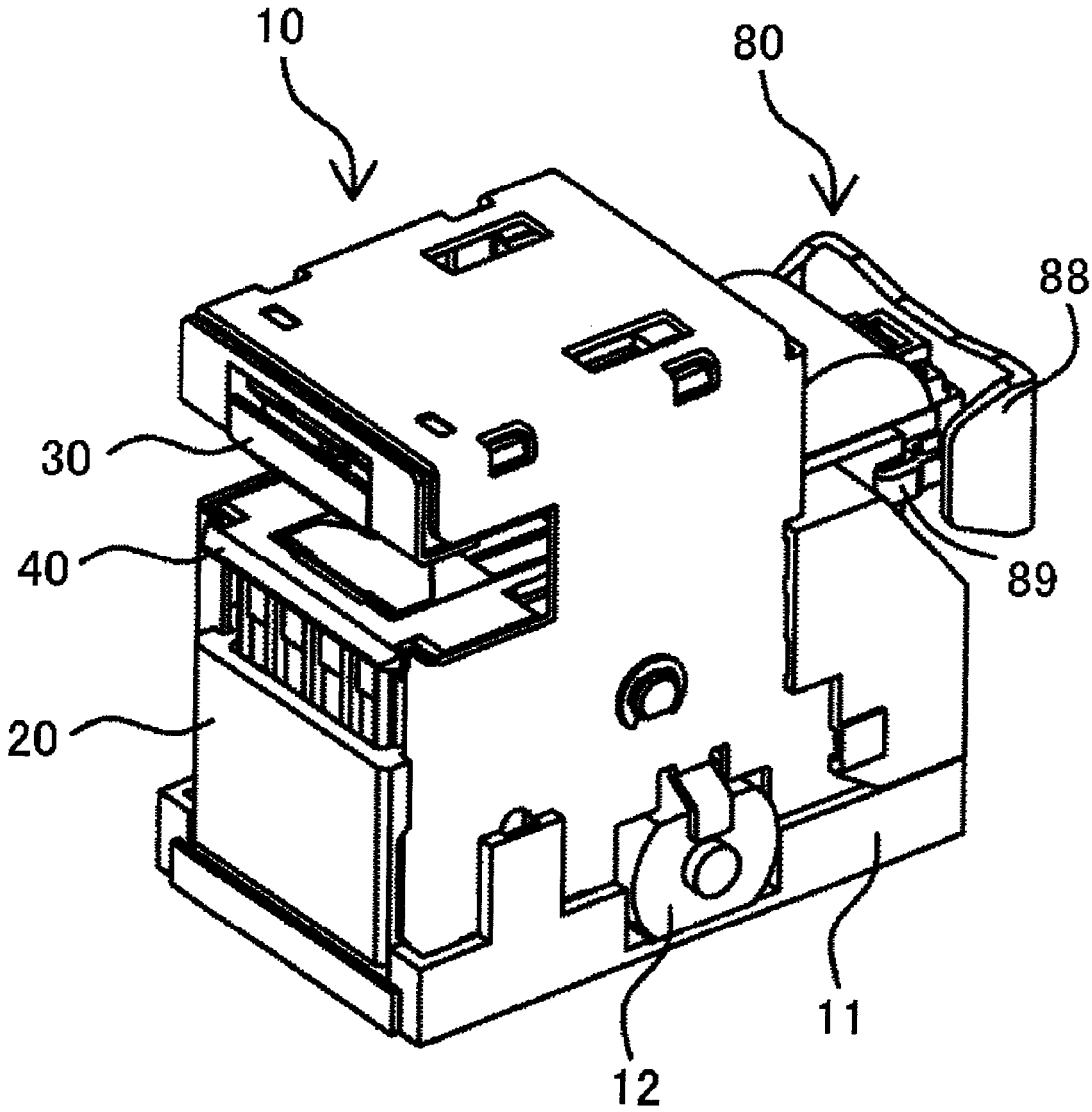
FIG. 1 is an overall perspective view of a stapler of a first exemplary embodiment of the present invention.
Figure 2:
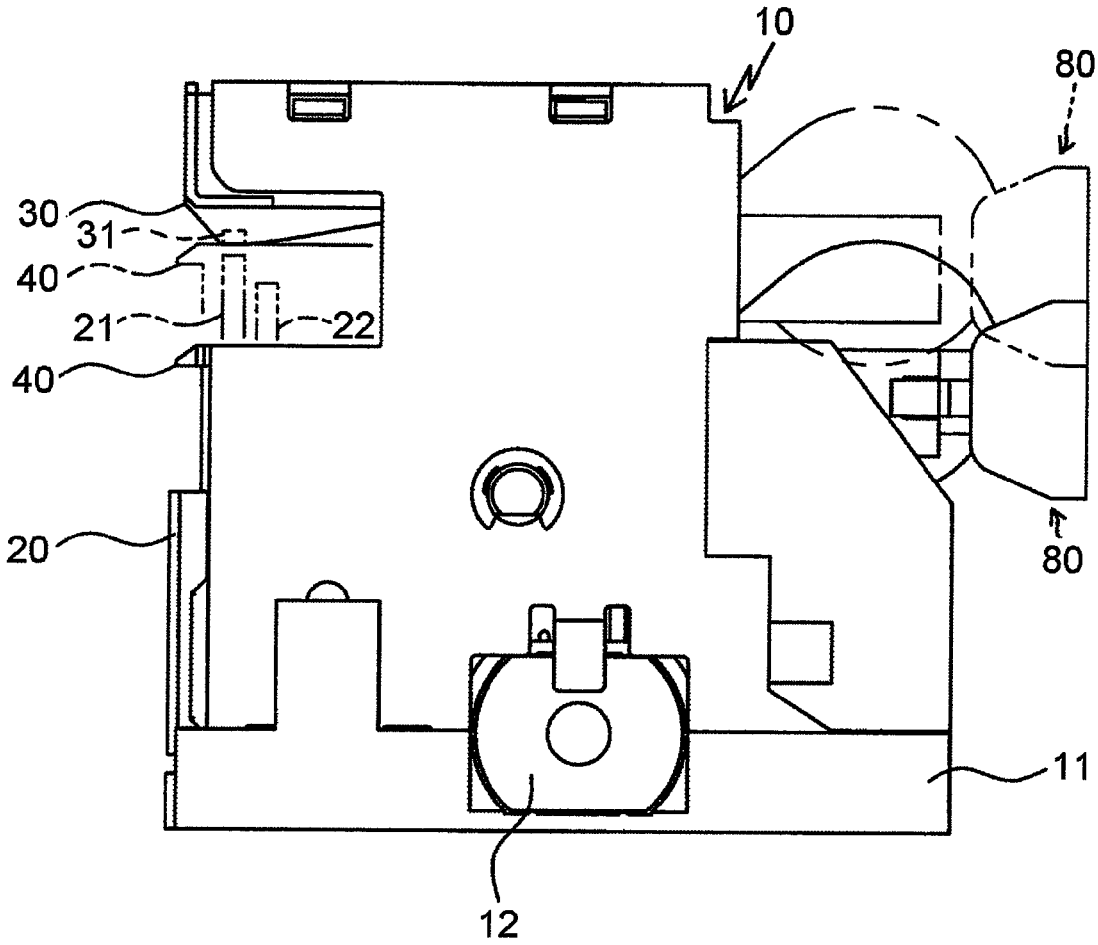
FIG. 2 is a side view of the stapler.
Figure 3:
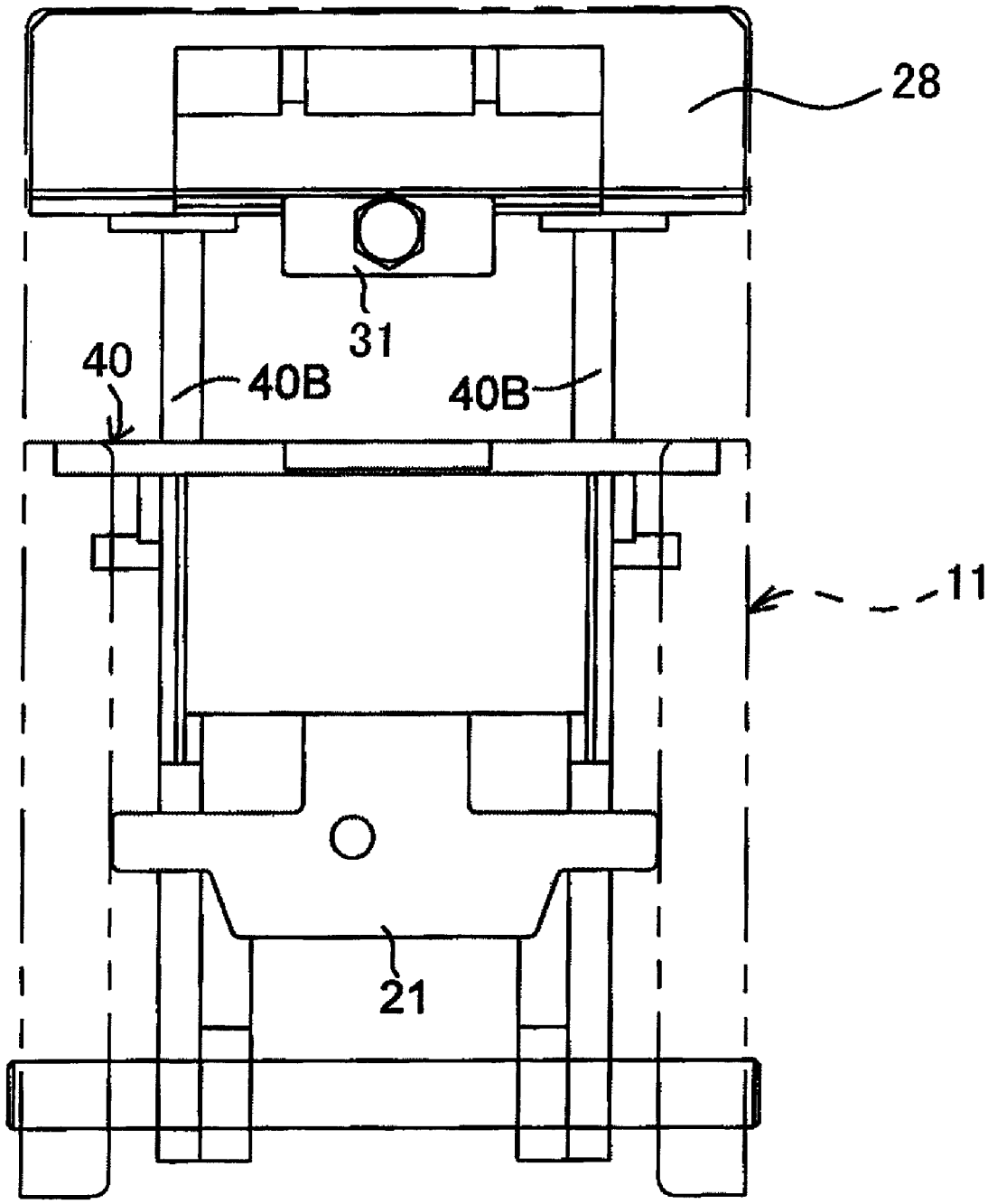
FIG. 3 is a front view showing an outline of a clinch positioning mechanism of the stapler.
Figure 4:
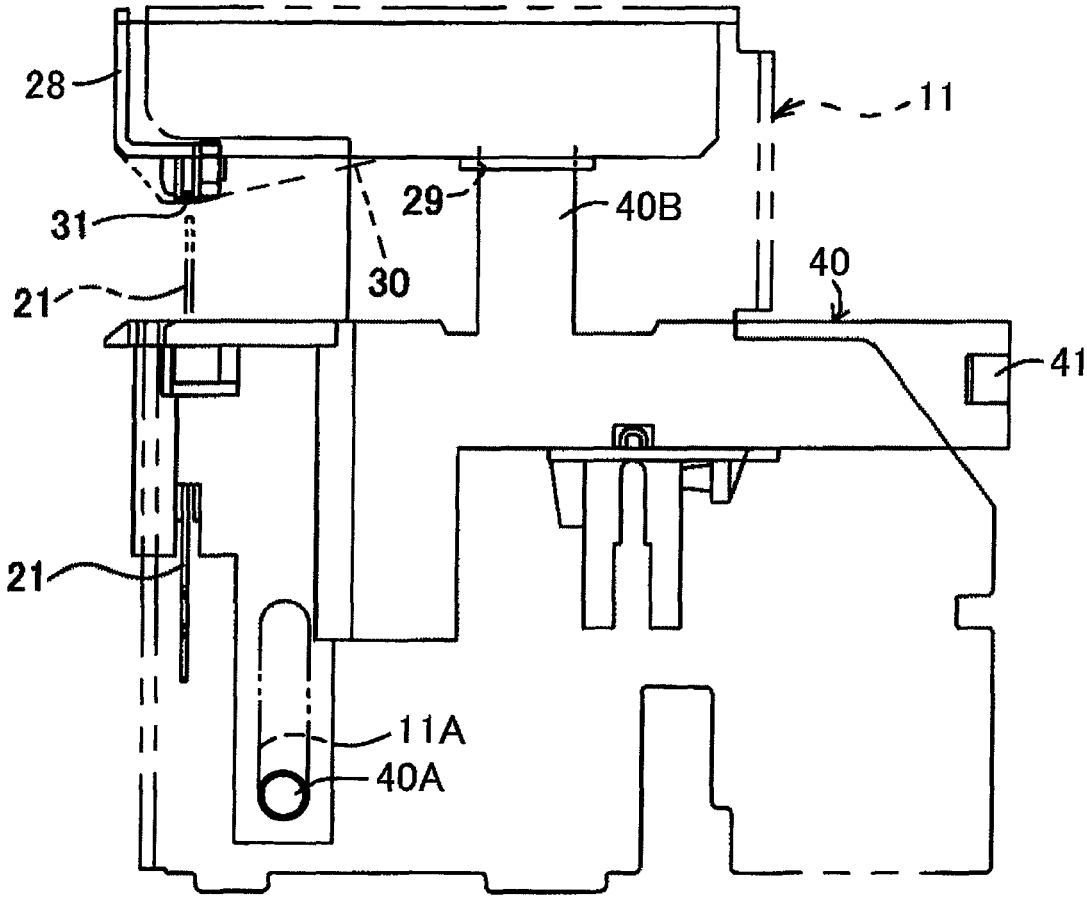
FIG. 4 is a side view showing an outline of the clinch positioning mechanism.
Figure 5:
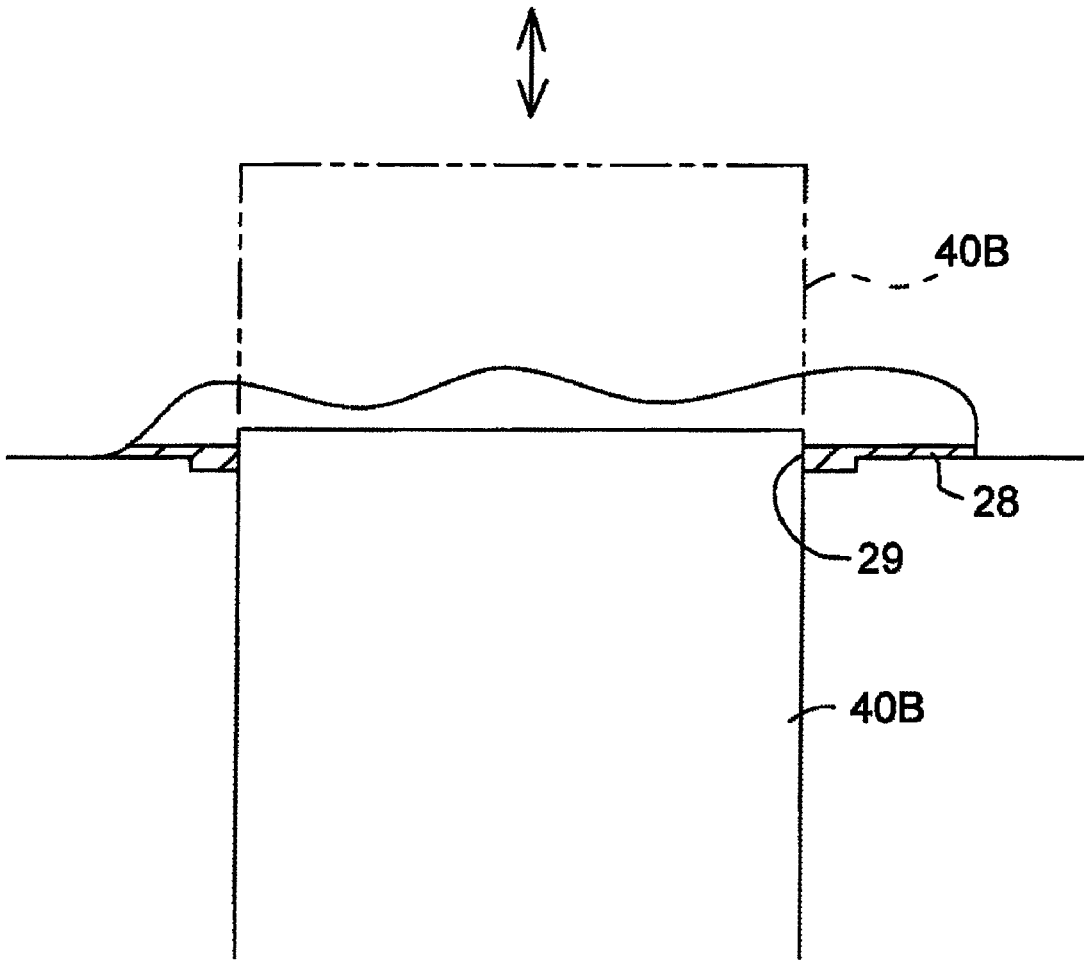
FIG. 5 is a view showing an outline of a primary portion of the clinch positioning mechanism.

The stapler is composed so that the staple cartridge can be attached to and detached from the stapler. FIG. 1 is an overall perspective view of the stapler of the first exemplary embodiment. FIG. 2 is a side view of the stapler. FIG. 3 is a front view showing an outline of a clinch positioning mechanism of the stapler. FIG. 4 is a side view showing an outline of the clinch positioning mechanism. FIG. 5 is a view showing an outline of a primary portion of the clinch positioning mechanism. FIGS. 6 to 10 are views showing an outline of the primary portion of a flat clinch mechanism.

(Outline of Constitution of Electrically Operated Stapler)

As shown in FIGS. 1 and 2, a stapler 10 includes a stapler body 11 composing a frame and others. The stapler 10 also includes: a reversible electric motor 12, which will be referred to as a motor hereinafter; a driver link 20, which is the same as a driver unit; a driver 21 shown by the two-dotted chain line in FIG. 2; a forming plate 22 shown by the two-dotted chain line in FIG. 2; a table 30; and a magazine 40.

The magazine 40 is attached with a staple cartridge 80. The magazine 40 is held through a spring not shown. The magazine 40 is separate from the driver link 20 by a given distance. The magazine 40 and the driver link 20 are once reciprocated in a vertical direction by the motor 12 which is a drive source, as described with the two-dotted chain line in FIG. 2. The motor 12 is fixed to the stapler body 11.

The driver 21 and the forming plate 22 are fixed to the driver link 20 shown in FIG. 2. The forming plate 22 forms a rod-shaped staple (not shown) into a C-shape. That is, the forming plate 22 forms a leg portion of the staple. The driver 21 is a plate for driving out a staple located at a front end of a driving passage and for driving the stapler into sheets of paper to be stapled (not shown). The driver 21 is positioned by the magazine 40.

As shown in FIG. 4, the clincher unit 28 includes: the table 30 (shown by the two-dotted chain line in FIG. 4); and a clincher 31 in which a clincher groove (not shown) is formed. The clincher unit 28 is arranged being opposed to the driver 21. The clincher 31 is a receiving table used for bending the leg portion of the stable driven out by the driver 21.

The table 30 and the clincher 31 are pushed onto the magazine 40 side (downward in FIG. 4) through a spring not shown. The table 30 composes the clincher unit 28. The clincher 31 is positioned by the clincher unit 28.

The driver link 20 (including the magazine 40 and the staple cartridge 80) is elevated by the motor 12 shown in FIG. 1 from an initial state shown in FIG. 2. That is, as shown in FIG. 4, a pair of pins 40A protrude from the magazine 40. The pins 40A are inserted into the guide groove 11A formed in the stapler body 11. The magazine 40 is elevated according to a length of the guide groove 11A.

As shown in FIG. 1, a knob 88 is arranged in the staple cartridge 80. A plane shape of the knob 88 is formed into a substantial C-shape so that the knob 88 can be held when the staple cartridge 80 is attached to and detached from the magazine 40. In the staple cartridge 80, a pair of engagement pieces 89 are integrally formed on the knob 88 side. The engagement pieces 89 are engaged with a stopper 41 (shown in FIG. 4) formed in the magazine 40. The staple cartridge 80 is attached to the magazine 40.

(Constitution of Clinch Positioning Mechanism)

As shown in FIGS. 3 and 4, a pair of guide pieces 40B, which are a portion of guide means, are protruded from the magazine 40 onto the clincher unit 28 side. The pair of guide pieces 40B are respectively formed into a plate shape, that is, a rectangular parallelepiped. On the other hand, as shown in FIG. 5, in the clincher unit 28, a guide hole 29, which is a portion of the guide means, is open corresponding to the respective guide piece 40B. At the time of assembling the stapler 10, the guide piece 40B is engaged in the guide hole 29. After then, the guide piece 40B and the guide hole 29 are maintained in a state of engagement.

At the time of clinching the leg portion of the staple not shown, the guide piece 40B and the guide hole 29 position the magazine 40, which is arranged so that the driver 21 can be elevated, and also position the clincher 31, which is fixed to the clincher unit 28. Therefore, the driver 21 and the clincher groove of the clincher 31 can be aligned with each other. That is, when the guide piece 40B is engaged in the guide hole 29, the clincher unit 28 and the magazine 40 are connected to each other. Therefore, the driver 21 and the clincher 31 (the clincher groove) are aligned with each other.

(Constitution of Flat Clinch Mechanism)

Figure 6:
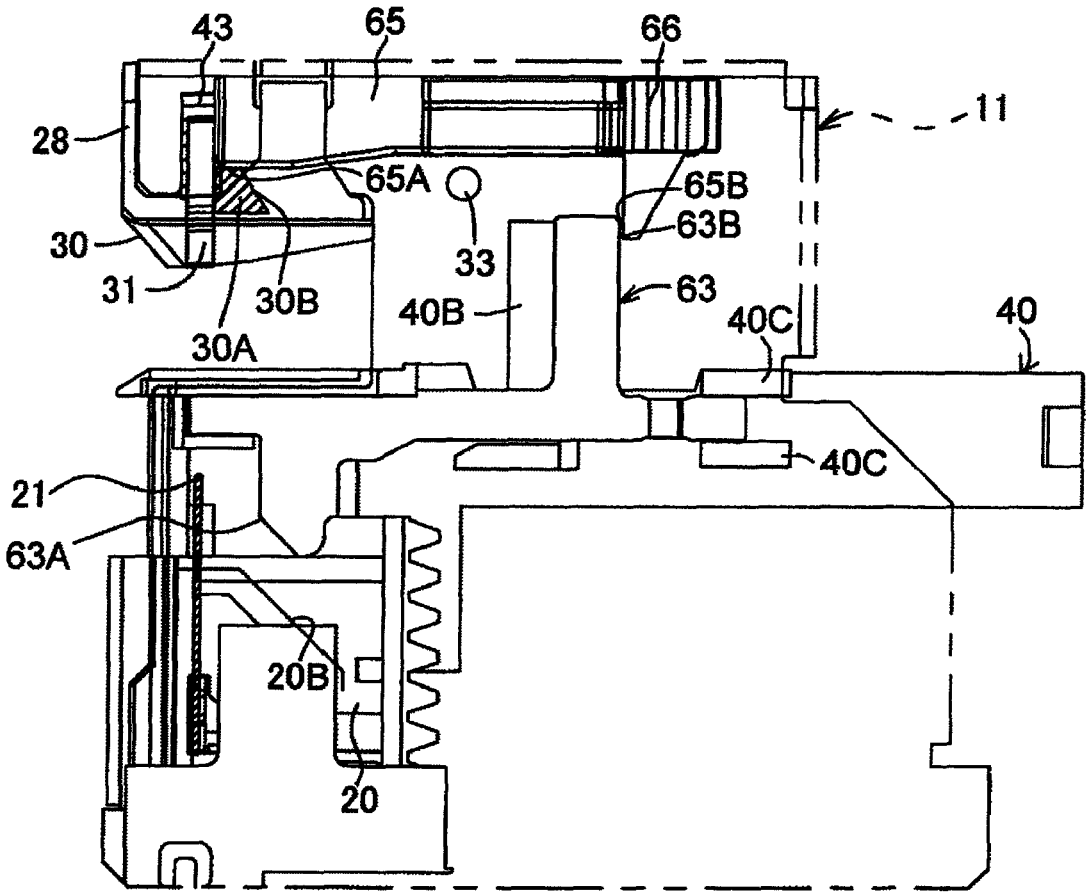
FIG. 6 is a view showing an outline of the primary portion of the flat clinch mechanism at a home position.
Figure 7:
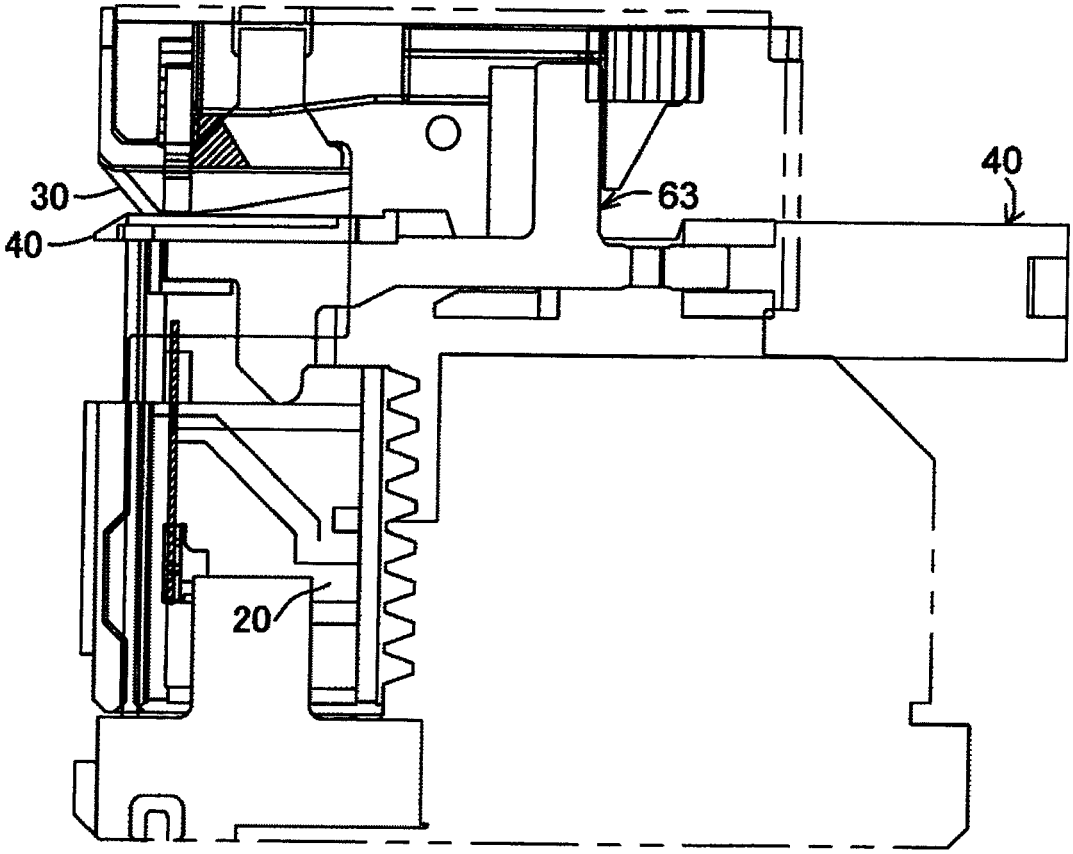
FIG. 7 is a view showing an outline of the primary portion of the flat clinch mechanism at a clamping completion position.

As shown in FIG. 6, the engaging portion 30A is formed on the table 30. A slider 65 is arranged corresponding to the engaging portion 30A. The slider 65 includes: a contact face 65A contacting with the engagement portion 30A of the table 30; and a contact face 65B contacting with a clinch lever 63 described later. In the slider 65, a spring 66 is arranged. By the spring 66, the slider 65 is pushed onto the clincher 31 side at all times. An inclined face 30B is formed in the engagement portion 30A.

The table 30 is turned round a support shaft 33 in a threshold angular range. Therefore, when the table 30 is turned, the engagement portion 30A is also turned round the support shaft 33. A spring 43 is arranged in the clincher 31. By the spring 43, the clincher 31 is pushed onto the table 30 side at all times.

As shown in FIG. 6, a pair of clinch levers 63 are arranged outside the guide piece 40B of the magazine 40. The clinch lever 63 slides along a guide portion 40C formed on a side of the magazine 40. Therefore, the clinch lever 63 is moved in accordance with the movement of the magazine 40.

The clinch lever 63 includes contact faces 63A and 63B. On the other hand, the driver link 20 includes a contact face 20B. The contact face 20B is contacted with the contact face 63A of the clinch lever 63. The contact faces 20B and 63A are formed being inclined so that the contact faces 20B and 63A can correspond to each other. That is, when the clinch lever 63 is pushed by the driver link 20, the clinch lever 63 is slid along the guide portion 40C. The clinch lever 63 is engaged in the guide hole 29 provided in the clincher unit 28.

The contact face 63B of the clinch lever 63 is contacted with the contact face 65B of the slider 65. The constitution of this flat clincher mechanism is similar to the constitution disclosed in JP-A-1-295769. At a home position shown in FIG. 6, the contact face 20B and the contact face 63A are separated from each other.

Actions of the First Exemplary Embodiment

Sheet stapling processing is executed by the stapler 10 as follows. When a sheet stapling signal is inputted from a copier or others into a control portion (not shown) of the stapler 10, the motor 12 is rotated in a normal direction and the driver link 20 (including the magazine 40 and the staple cartridge 80) is raised. That is, the driver link 20, which is in the initial state shown in FIGS. 1 to 4, is further raised to a clinch completion position, at which the leg portion of the staple not shown is clinched, through a clamp completion position (the position shown by the two-dotted chain line in FIG. 2) at which the sheets of paper not shown are clamped by the table 30 and the magazine 40.

After the completion of clamping, the driver 21 drives out a staple from the staple cartridge 80 to the sheets of paper. When the magazine 40 is further raised to the clinch completion position, the leg portion penetrating the sheets of paper is bent by the clincher 31 (shown in FIGS. 2 and 4) which is arranged being opposed to the driver 21. In this way, clinching is completed. After clinching has been completed, the motor 12 is reversed and the driver link 20 is returned to the initial state shown in FIGS. 1 to 4.

Figure 8:
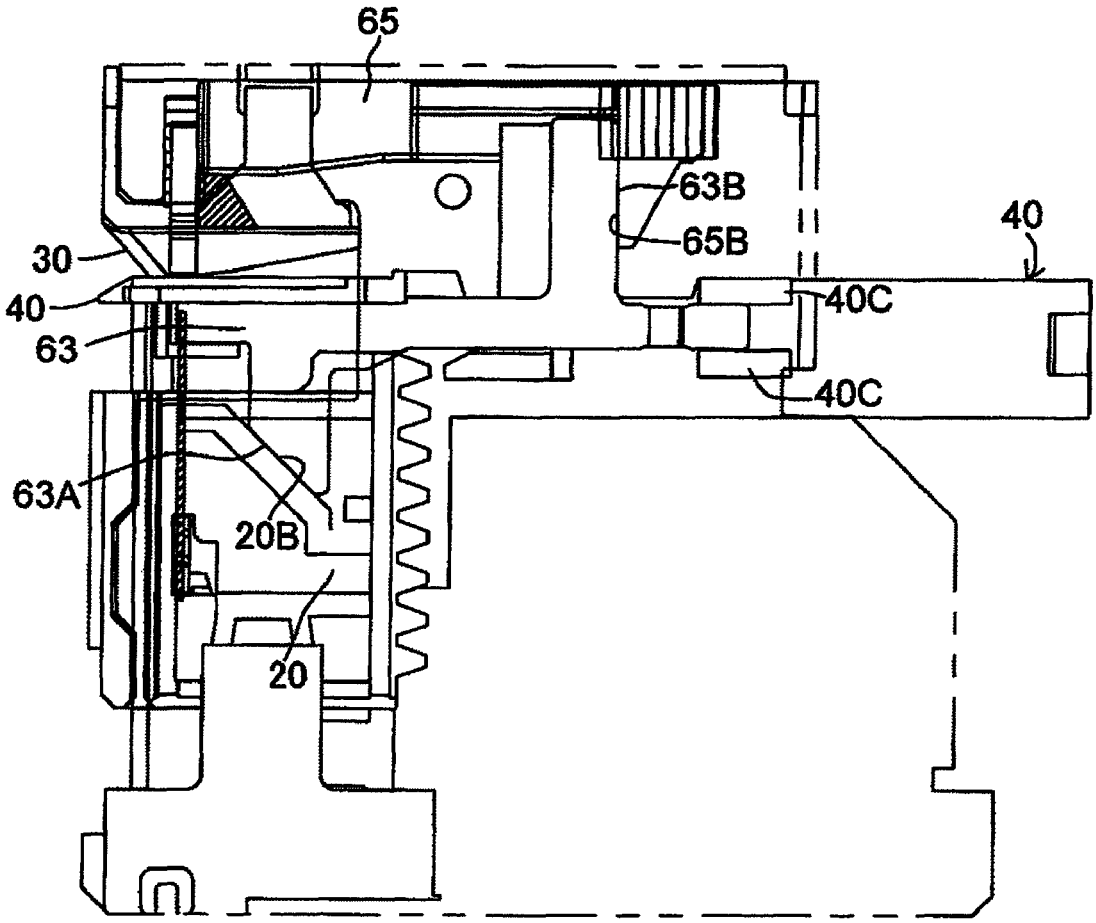
FIG. 8 is a view showing an outline of the primary portion of the flat clinch mechanism at the time of starting going back.

Referring to FIGS. 6 to 10, actions of the flat clinch mechanism will be explained below. When the flat clinch mechanism is moved from the home position shown in FIG. 6 to the clamp completion position shown in FIG. 7, sheets of paper (not shown) are clamped by the table 30 and the magazine 40. At the clamp completion position, a movement of the magazine 40 is once stopped and the driver link 20 starts moving with respect to the magazine 40 (the clinch lever 63). As shown in FIG. 8, when the driver link 20 is moved onto the magazine 40 side, the contact face 20B of the driver link 20 and the contact face 63A of the clinch lever 63 come into contact with each other. Therefore, the clinch lever 20 is slid onto the guide portion 40C side. As a result, the contact face 63B of the clinch lever 63 comes into contact with the contact face 65B of the slider 65.

Figure 9:
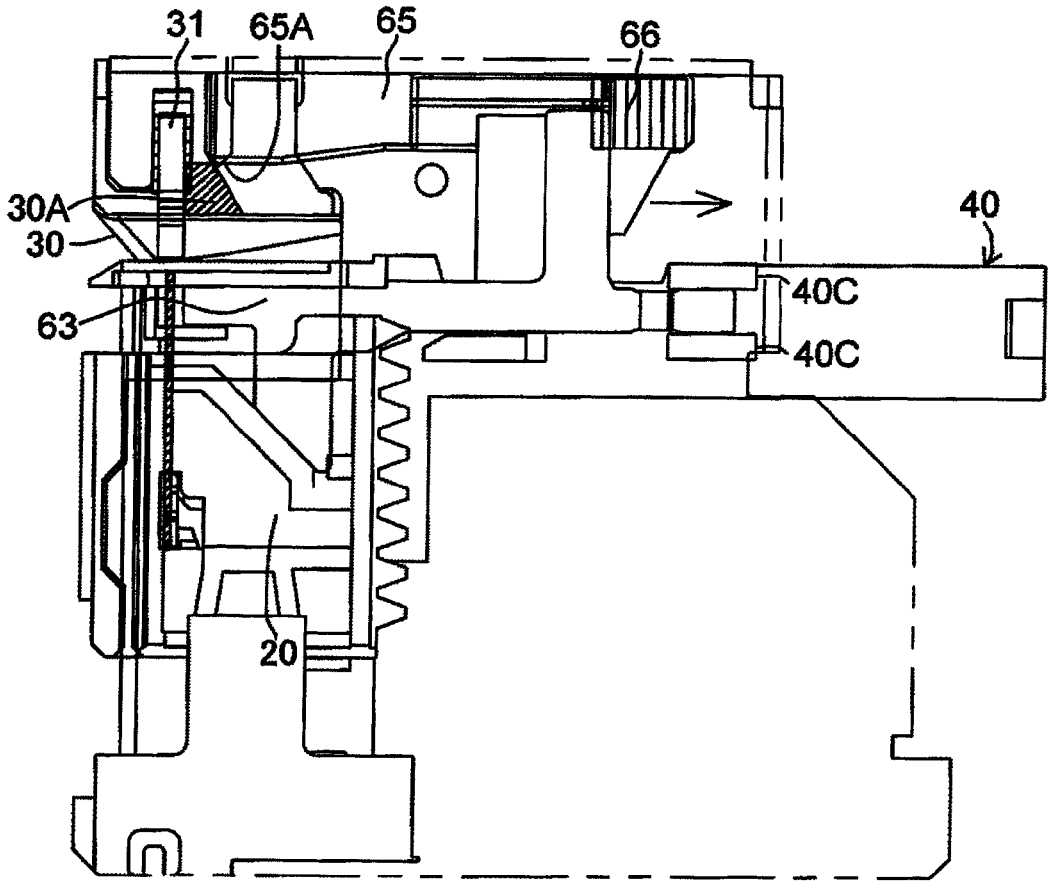
FIG. 9 is a view showing an outline of the primary portion of the flat clinch mechanism right before clinching.

When the driver link 20 is further raised and comes to a position right before clinching, as shown in FIG. 9, the clinch lever 63 is further slid onto the guide portion 40C side and the slider 65 is slid in an arrowed direction (the right) resisting a pushing force of the spring 66. That is, as shown in FIG. 9, the slider 65 slides on the engagement portion 30A.

Figure 10:
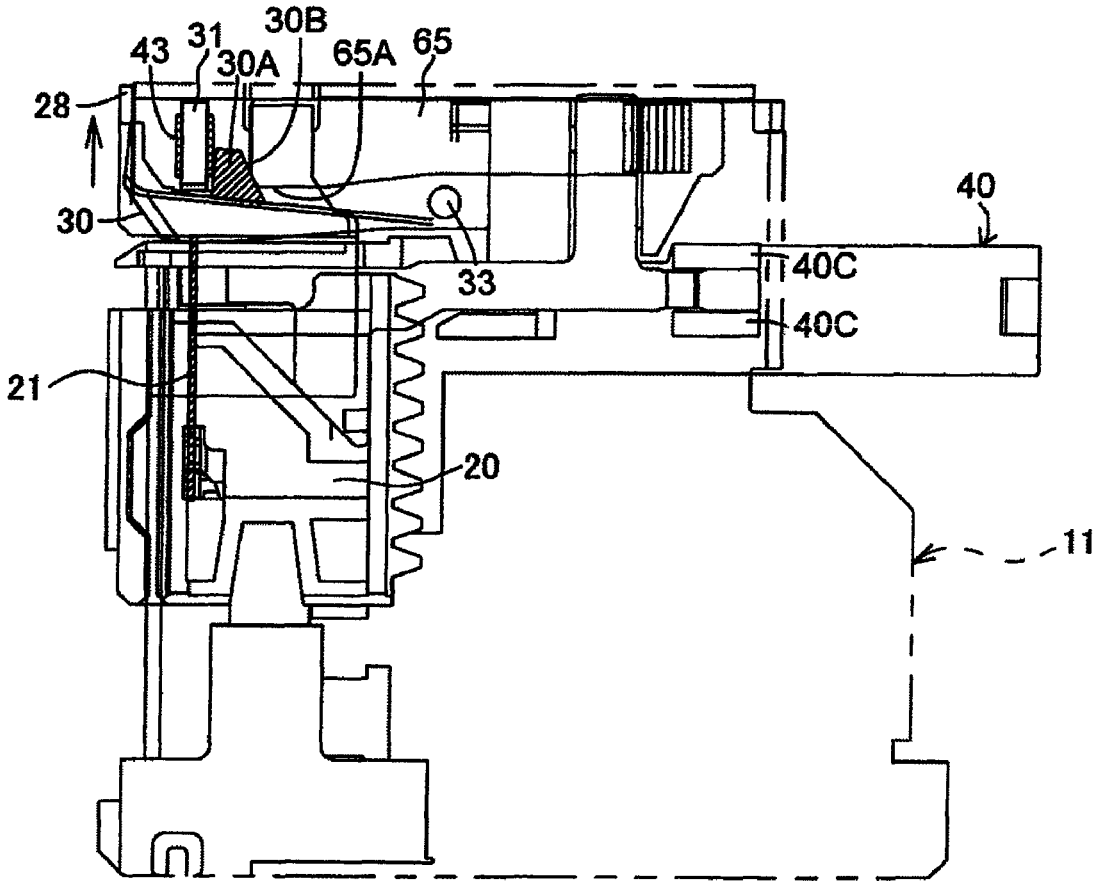
FIG. 10 is a view showing an outline of the primary portion of the flat clinch mechanism at the time of completion of clinching.

As shown in FIG. 10, when the contact face 65A of the slider 65 is separated from a face of the engagement portion 30A, the table 30 is turned round the support shaft 33 and enters the clincher unit 28. That is, when the driver link 20 (including the driver 21) and the magazine 40 are further moved in the arrowed direction (upward), clinching is started. In this case, the clincher 31 is always pushed onto the driver 21 side resisting a pushing force of the spring 43. However, the clincher 31 is pushed by the leg portion of the staple not shown and moved in the arrowed direction.

When the movement of the driver 21 is completed in the state shown in FIG. 10 in which the table 30 completely enters the clincher unit 28, clinching is completed. That is, the leg portions of the staple not shown are bent to be flat by the driver 21 along a lower face of the sheet of paper while the leg portions of the staple are directed in the bending directions, which are opposed to each other, in the clincher groove (not shown) of the clincher 31 which has been positioned in the stapler body 11. In order to downsize the stapler body 11, this flat clinch mechanism is composed so that a stroke of the driver 21 can be made up. That is, in order to make the table 30 completely get into the clincher unit 28, the slider 65 is further slid onto the guide portion 40C side by the inclined face 30B of the engagement portion 30A which is integrally formed on the table 30.

As shown in FIG. 5, when the magazine 40 is elevated with respect to the clincher unit 28, the guide piece 40B always slides along the side wall of the guide hole 29. That is, even at the position at which clinching is started and at the position at which clinching is completed, positions respectively corresponding to the driver 21 and the clincher 31 (the clincher groove) agree with each other. Therefore, the leg portion of the staple not shown can be surely bent and clinched. That is, in the first exemplary embodiment, since the guide piece 40B is guided along the guide hole 29, the leg portion of the staple can be surely clinched. Therefore, according to the first exemplary embodiment, it is unnecessary to provide an alignment process and it is also unnecessary to enhance the accuracy of a plurality of parts, which is unlike the related-art clinch positioning mechanism. Therefore, the stapler 10 can be made to be inexpensive.

In the first exemplary embodiment, the engagement mechanism is composed in such a manner that the guide means formed integrally with the driver link 20 and the clincher unit 28 are directly engaged with each other, that is, in the engagement mechanism, the guide piece 40B is engaged in the guide hole 29. Therefore, positioning can be executed without increasing the number of parts of the stapler. That is, the number of parts used for positioning is not increased. Therefore, it is possible to provide an inexpensive stapler 10 in which the accumulation tolerance of parts can be reduced and the driver 21 and the clincher 31 can be easily aligned with each other.

In the initial state shown in FIGS. 3 and 4, the guide piece 40B may be separated from the guide hole 29. In this case, the guide piece 40B may be inserted into the guide hole 29 at the time of clamping (at the time of starting clinching at the latest). For example, when a forward end portion of the guide piece 40B is tapered, it can be easily inserted into the guide hole 29.

The clincher unit 28 may be made to be a so-called floating structure in which the clincher unit 28 is movable and the driver 21 and the clincher 31 may be aligned with each other at the time of clamping. Further, it is possible to adopt a structure contrary to that of the first exemplary embodiment in which the guide piece is protruded from the clincher unit 28 and the guide hole is opened in the magazine 40 (including parts composing the driver unit).

Second Exemplary Embodiment

Figure 11:
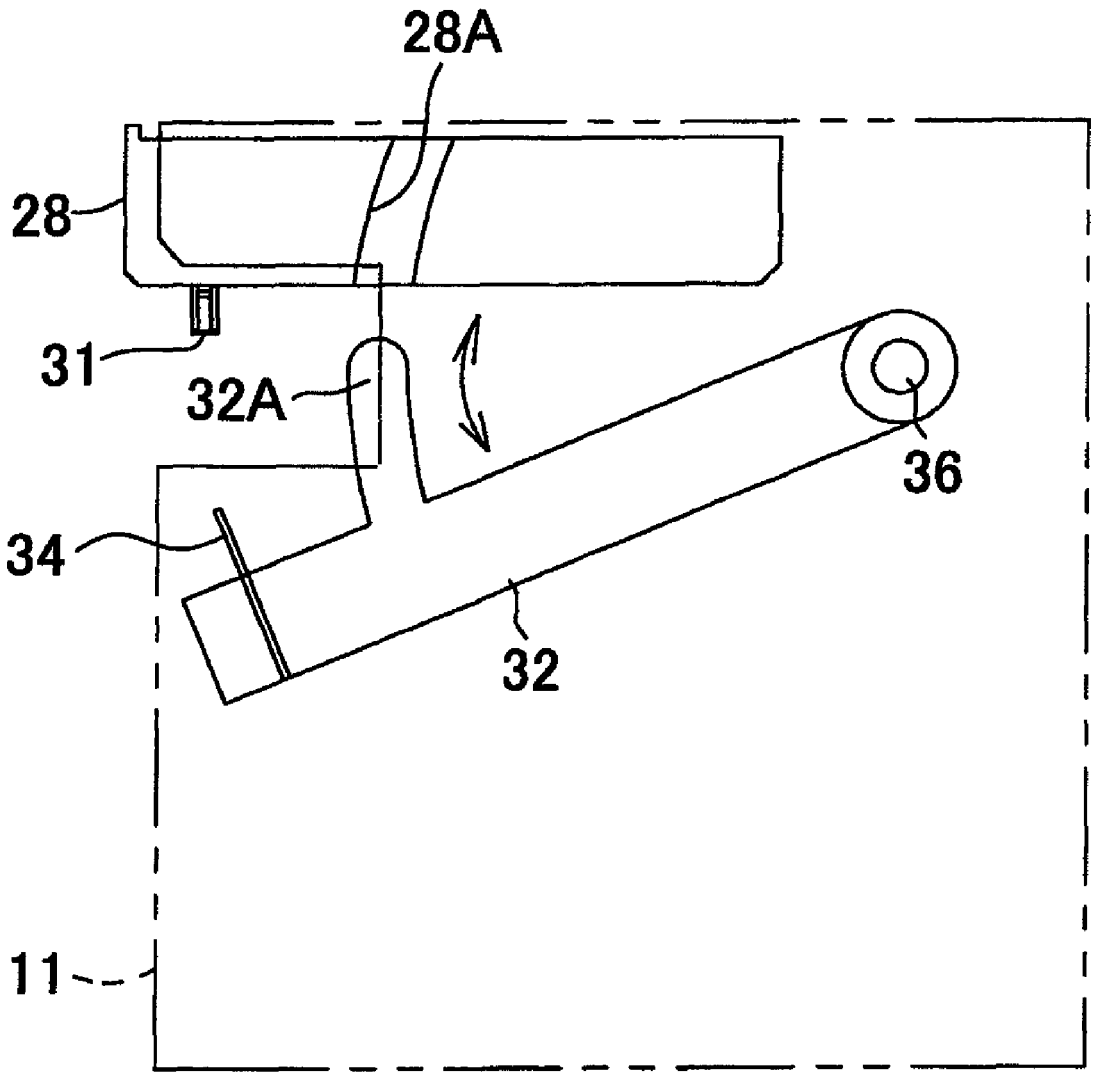
FIG. 11 is a schematic illustration showing a clinch positioning mechanism of a second exemplary embodiment of the present invention.

Referring to FIG. 11, explanations will be made into a clinch positioning mechanism of a second exemplary embodiment of the present invention. FIG. 11 is a schematic illustration showing a clinch positioning mechanism of the second exemplary embodiment. Like reference numerals are used to indicate like parts in the first exemplary embodiment. A stapler of the second exemplary embodiment is different from that of the first exemplary embodiment and the driver link 32 is turned round the support shaft 36 in a threshold angular range. In this case, the driver link 32 may be linked with the magazine.

In the clinch positioning mechanism of the second exemplary embodiment, in the initial state shown in FIG. 11, the guide piece 32A of the driver link 32 is separate from the arcuate guide groove 28A of the clincher unit 28. A forward end portion of the guide piece 32A is formed into a semicircular shape, so that the guide piece 32A can be easily inserted into the guide groove 28A. When the leg portion of the staple not shown is clinched by the clincher 31 at the latest, the guide piece 32A is inserted into the guide groove 28A. Therefore, the driver 34 and the clincher groove not shown of the clincher 31 are aligned with each other.

According to the second exemplary embodiment, while the driver link 32 is turning, the guide piece 32A is inserted into the guide groove 28A and successively guided along the guide groove 28A. Therefore, the driver 34 and the clincher 31 can be easily aligned with each other. In the second exemplary embodiment, even in the waiting state, the guide piece 32A may be previously inserted into the guide groove 28A. Other operational effects of the second exemplary embodiment are the same as those of the first exemplary embodiment. Therefore, the detailed explanations are omitted here.

In the first and second exemplary embodiments described above, the engagement mechanism is composed in such a manner that the guide means formed integrally with the driver link and the clincher unit are directly engaged with each other. However, the exemplary embodiments may be composed in such a manner that another guide member (the guide means) is newly arranged in the Hotchkiss body (including the frame). In the mechanism of the exemplary embodiments, only the driver unit is once reciprocated. However, in the exemplary embodiment, the clincher unit (including a case in which only the clincher is driven) or both units may be driven. Further, the present invention can be applied in the same manner to the split type stapler disclosed in JP-UM-A-6-63343. Furthermore, the present invention can be applied to a manually operated stapler.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A clinch positioning mechanism comprising:

a driver unit which includes a driver for driving out a staple;

a clincher unit which includes a clincher for bending and clinching a leg portion of the staple, and which is arranged being opposed to the driver, wherein at least one of the driver unit and the clincher unit is movably arranged, the driver unit includes a first guide portion for guiding the driver and the clincher unit includes a second guide portion for guiding the clincher so that the driver and the clincher are aligned with each other when one of the driver unit and the clincher unit moves toward the other of the driver unit and the clincher unit in operation at the latest when clinching the leg portion of the staple by the clincher, the first guide portion and the second guide portion are directly engaged with each other, and the first guide portion slides along the second guide portion when one of the driver unit and the clincher unit moves toward the other of the driver unit and the clincher unit for clinching the leg portion of the staple.

2. The clinch positioning mechanism according to claim 1, wherein the first guide portion is integrally formed in the driver unit and the second guide portion is integrally formed in the clincher unit.

3. A clinch positioning mechanism comprising:

a driver unit which includes a driver for driving out a staple, and a guide piece for guiding the driver;

a clincher unit which includes a clincher for bending and clinching a leg portion of the staple, and a guide hole for guiding the clincher and engaging with the guide piece, the clincher unit arranged being opposed to the driver, wherein at least one of the driver unit and the clincher unit is movably arranged, the driver and the clincher are aligned with each other by engaging the guide piece in the guide hole when one of the driver unit and the clincher unit moves toward the other of the driver unit and the clincher unit in operation at the latest when clinching the leg portion of the staple by the clincher, the guide piece and the guide hole are directly engaged with each other, and the guide piece slides along a side wall of the guide hole when one of the driver unit and the clincher unit moves toward the other of the driver unit and the clincher unit for clinching the leg portion of the staple.

4. The clinch positioning mechanism according to claim 3, wherein the guide piece is integrally formed in the driver unit and the guide hole is integrally formed in the clincher unit.

* * * * *